US005880749A

United States Patent [19]

Kikkawa et al.

[11] Patent Number: 5,880,749

[45] **Date of Patent: *Mar. 9, 1999**

[54] RECORDING METHOD AND APPARATUS IN WHICH USE OF RECORDING HEADS IS EQUALIZED

[75] Inventors: Shoushi Kikkawa, Kawasaki; Isao Tsukada, Okaya; Manabu Kanazawa, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 184,047

[22] Filed: Jan. 21, 1994

[30] Foreign Application Priority Data

Jan. 25, 1993 [JP] Japan ..... 5-027165

[51] Int. Cl.[6] ..... B41J 29/38; B41J 2/145; B41J 2/21

[52] U.S. Cl. ..... 347/9; 347/12; 347/40; 347/43

[58] Field of Search ..... 347/43, 86, 33, 347/41, 37, 5, 9, 12, 17, 14, 40; 400/323, 323.1, 82

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,419,678 | 12/1983 | Kasugayama et al. | 347/86 |
| 4,459,600 | 7/1984 | Sato et al. | 347/47 |
| 4,463,359 | 7/1984 | Ayata et al. | 347/56 |
| 4,528,576 | 7/1985 | Koumura et al. | 347/43 X |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,772,146 | 9/1988 | Saito et al. | 400/649 |
| 4,774,529 | 9/1988 | Paranjpe et al. | 347/43 |
| 5,103,244 | 4/1992 | Gast et al. | 347/33 |
| 5,140,344 | 8/1992 | Tsukada et al. | 346/139 R |
| 5,200,767 | 4/1993 | Tsukada et al. | 346/139 R |
| 5,276,466 | 1/1994 | Tsukada et al. | 346/139 R |

FOREIGN PATENT DOCUMENTS

| | | | |
|---|---|---|---|
| 0 452 116 A1 | 10/1991 | European Pat. Off. | 347/17 |
| 59-123670 | 7/1984 | Japan . | |
| 59-138461 | 8/1984 | Japan . | |
| 61-202850 | 9/1986 | Japan | 347/17 |
| 2-265765 | 10/1990 | Japan | 400/82 |
| 3-295658 | 12/1991 | Japan | B41J 2/13 |

*Primary Examiner*—David F. Yockey
*Attorney, Agent, or Firm*—Fitzpatrick, Cella, Harper & Scinto

[57] ABSTRACT

A recording apparatus, which records on a recording medium by using a plurality of recording heads, includes: a carriage for moving the plurality of recording heads in a direction crossing the direction in which the recording medium is fed; and a control section which, when at least two of the plurality of recording heads are of the same recording color, performs recording by alternately using such recording heads for a predetermined number of lines, whereby the amounts of ink consumed by the plurality of recording heads are equalized to make the ink service lives of the recording heads substantially the same.

33 Claims, 15 Drawing Sheets

RECORDING METHOD AND APPARATUS IN WHICH USE OF RECORDING HEADS IS EQUALIZED

BACKGROUND OF THE INVENTION

1. Field of the Invention

The present invention relates to a recording apparatus which records on a recording medium by moving a plurality of heads in predetermined directions.

2. Description of the Related Art

Disposable-type recording heads have been widely used in recording apparatuses like word processors and electronic calculators having printers. For example, in many serial-type recording apparatuses for color recording, a plurality of recording heads are integrally attached to a carriage of the apparatus and arranged side by side thereon.

In such a color recording apparatus, the arrangement of the recording heads for different colors is determined beforehand, and the recording heads are operated in accordance with the order of their arrangement to selectively use them for recording.

However, when two-color printing, for example, in red and black, is to be performed, red and black recording heads, which are arranged at predetermined positions on the carriage, are selectively operated, line by line, by a CPU provided inside the recording apparatus body, in accordance with the data input from the outside.

For example, in the case of an electronic calculator having a printer, a plus data output is usually recorded in black, and a minus data output is recorded in red. However, there may also be a case where the two recording heads mounted in such a calculator are of the same color.

In this case, there is no need to select between recording colors in accordance with the input data, as either of the two heads is usable for recording. However, this leads to the following problem: in the above-described system in which the CPU controls recording, it is previously determined which of the two heads is to be used for recording according to the kind of data to be recorded. That is, each time recording is performed, the CPU determines the recording head to be used in accordance with the kind of data input from the outside, with the result that although the two heads are of the same color, they are not equally used, as the head to be used depends on the kind of data input from the outside. Thus, there is the possibility that the amount of ink used by one head will be different from that used by the other. This is undesirable from the viewpoint of efficient use of ink.

SUMMARY OF THE INVENTION

It is accordingly an object of the present invention to provide a recording apparatus in which the respective amounts of ink consumed by a plurality of recording heads are equalized so that all of the heads have substantially the same ink service life, thereby solving the above problem in the related art.

Another object of the present invention is to provide a recording apparatus in which the respective numbers of times of use of a plurality of recording heads using ink of the same color are equalized by causing the recording heads to operate alternately. This enables the respective amounts of ink used by the recording heads to be equalized so as to make the lengths of the respective service lives of the recording heads as equal as possible to each other, thereby making it possible for the recording heads to be replaced at the same time.

Still another object of the present invention is to provide a recording apparatus which comprises: a carriage for moving a plurality of recording heads in a direction crossing the direction in which a recording medium is fed; and a control section which, when at least two of the plurality of recording heads are of the same recording color, performs recording by alternately using such recording heads for a predetermined number of lines.

A further object of the present invention is to provide a printer for performing printing on a printing medium by using a plurality of ink-jet heads, the printer comprising: a carriage for moving the plurality of ink-jet heads in a direction crossing the direction in which the printing medium is fed; and a control section which, when at least two of the plurality of ink-jet heads are of the same printing color, performs recording by alternately using such ink-jet heads for a predetermined number of lines.

A still further object of the present invention it to provide a recording method for performing recording on a recording medium by using a plurality of heads moving in a direction crossing the direction in which the recording medium is fed, the method comprising the steps of: a selection step for selecting between a first mode in which recording is performed in different recording colors by the plurality of heads, and a second mode in which recording is performed in the same recording color by the plurality of heads; a first recording step for performing recording in a plurality of colors by using the plurality of heads when the first mode is selected in the selection step; and a second recording step for performing recording in the same recording color by using alternately the plurality of heads for a predetermined number of lines when the second mode is selected in the selection step.

DETAILED DESCRIPTION OF THE PREFERRED EMBODIMENTS

[First Embodiment]

Figure 1:
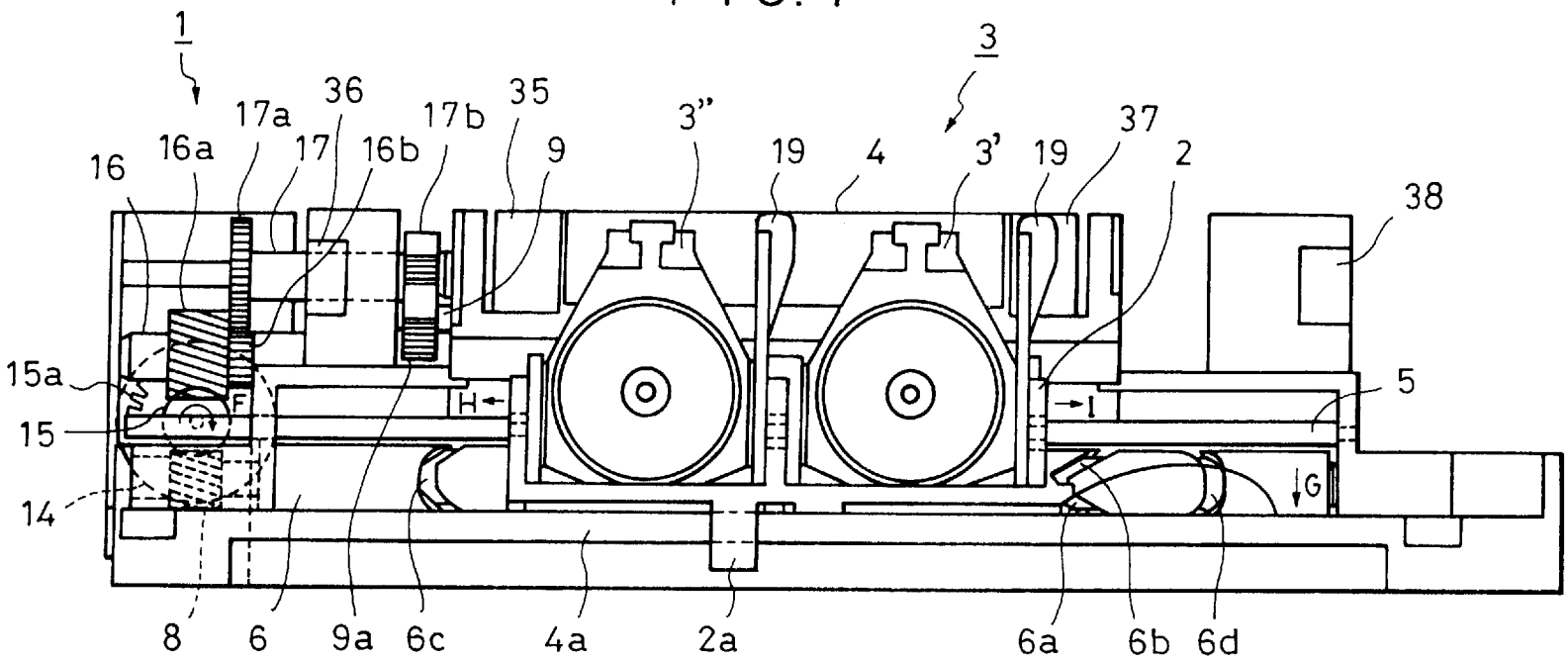
FIG. 1 is a front view of a recording apparatus.
Figure 2:
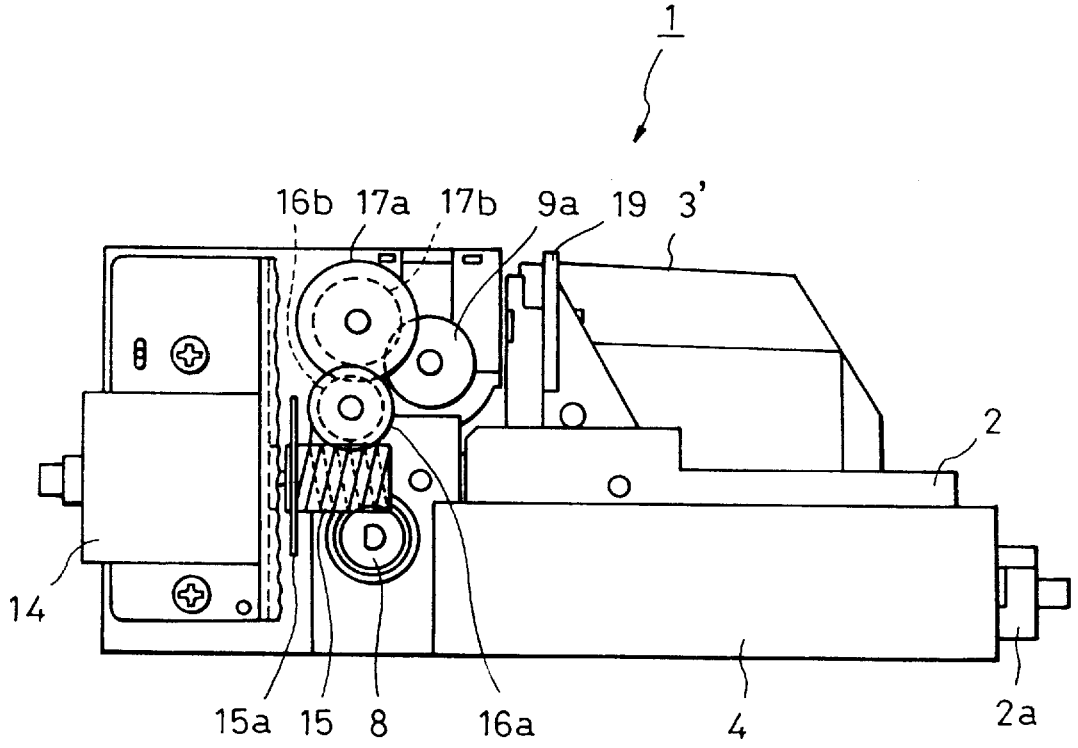
FIG. 2 is a left-hand side view of the recording apparatus.

A recording apparatus according to an embodiment of the present invention will now be described with reference to the drawings. This recording apparatus may be one having ink-jet heads for recording on a recording medium. The embodiment described below is applied to a serial-type ink jet recording apparatus having two detachable, disposable-type recording heads.

The serial-type recording apparatus, to which this embodiment is applied, has an apparatus body 1, on which a carriage 2 is mounted in such a way as to be capable of reciprocating in directions indicated by arrows H and I. Two recording heads 3 (3' and 3"), serving as the recording means described below, are attached to the carriage 2, which is rotatably mounted on a guide shaft 5 supported at either end by a frame 4. A two-directional lead screw 6 is rotatably supported by the frame 4. The lead screw 6 has thread-like grooves 6*a* and 6*b* whose phases differ by 180°. The grooves 6*a* and 6*b* are connected to each other at groove ends 6*c* and 6*d*. The grooves 6*a* and 6*b* are engaged with a screw pin 7 protruding from the rear end of the carriage 2 (see FIG. 3). Further, a projection 2*a* having an L-shaped cross section is formed at the front end of the carriage 2 so as to engage with a rail 4*a* formed on the frame 4, thereby guiding the reciprocal movement of the carriage 2. A screw wheel gear 8 is attached to the left-hand end of the two-directional lead screw 6 (see FIG. 1).

Figure 3:
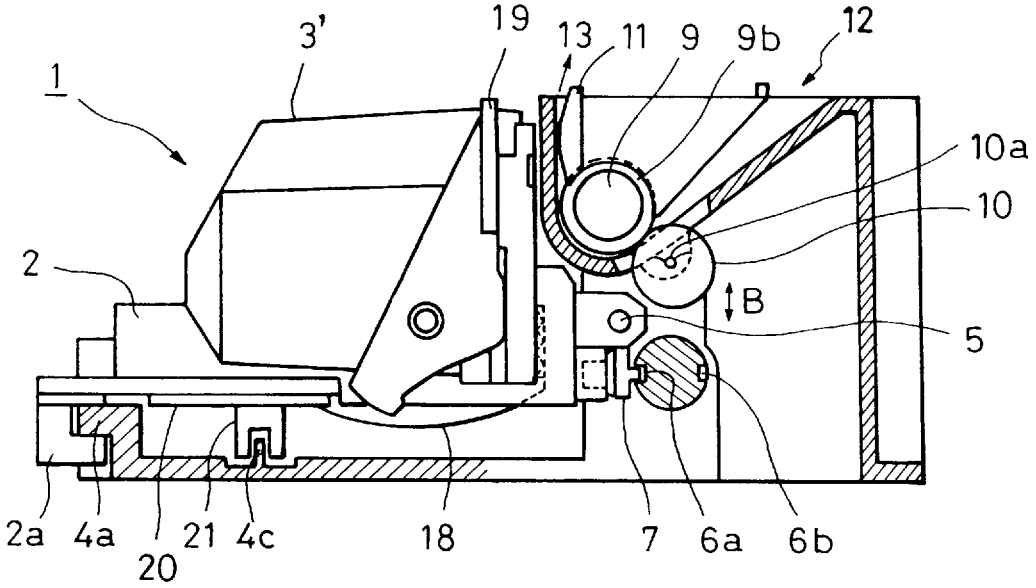
FIG. 3 is a right-hand side view of the recording apparatus.

Numeral 9 indicates a feeding roller for feeding a recording sheet serving as the recording medium. A feeding roller gear 9*a* is attached to the left-hand end of the feeding roller 9 (see FIG. 1). The end portions of the feeding roller 9 are rotatably supported by the frame 4, and a ring-like feeding member 9*b* made of an elastic material (e.g., rubber) is provided on the central portion of the feeding roller 9 (see FIG. 3). A pinch roller 10 is provided at a position opposed to the feeding member 9*b*. The pinch roller 10 is rotatably supported by a pinch roller axle 10*a*, which is rotatably supported by the frame 4 of the apparatus body 1. The pinch roller 10, which is movable in the directions indicated by arrows B in FIG. 3, is held in pressure contact with the feeding roller 9 due to the resilience of the pinch roller axle 10*a*. Thus, the pinch roller 10 rotates with the feeding roller 9, and the recording sheet is fed by their cooperative action.

Further, as shown in FIG. 3, a platen 11 for supporting the recording sheet at the recording position is detachably mounted on the frame 4. The recording sheet is inserted into the apparatus through an inlet 12 and fed by the feeding roller 9 and the pinch roller 10 by way of the platen 11 to be discharged through an outlet 13.

Numeral 14 indicates a DC motor serving as the drive source. The DC motor 14 rotates in the direction of an arrow F in FIG. 1. A motor worm gear 15 is fitted onto the driving shaft of the DC motor 14. The motor worm gear 15 is engaged with the screw wheel gear 8 and with a gear section 16*a* of a feeding wheel gear 16. The feeding wheel gear 16 also has a gear section 16*b*, which rotates integrally with the gear section 16*a* and is engaged with a gear section 17*a* at the left-hand end of an intermediate sheet feeding gear 17, which also has a feeding gear section 17*b* at the right-hand end thereof that is rotatably supported by the frame 4. The gear section 17*b* consists of a partially-cut-out gear, which intermittently engages with the feeding roller gear 9*a* at fixed intervals.

Thus, by rotating the DC motor 14 in the direction of the arrow F, the two-directional lead screw 6 is caused to rotate in the direction indicated by the arrow G of FIG. 1 by the force transmitted through the motor worm gear 15 and the screw wheel gear 8, and, due to the screw pin 7 being engaged with the screw groove 6*a*, the carriage 2 moves in the direction indicated by the arrow H. When the carriage 2 moves further in the direction indicated by the arrow H, the screw pin 7 reaches the screw groove end 6*c*. Then, the screw pin 7 engages with the screw groove 6*b*, which is connected to the screw groove 6*a*, to cause the carriage 2 to move in the direction indicated by the arrow I. When the carriage 2 moves further in the direction indicated by the arrow I, the screw pin 7 reaches the screw groove end 6*d*. Then, the screw pin 7 engages with the screw groove 6*a*, which is connected to the screw groove 6*b*, to cause the carriage 2 to move in the direction indicated by the arrow H. By repeating the above-described operations, the carriage 2 is reciprocated in the directions indicated by the arrows H and I by the rotation of the DC motor 14 in a single direction.

Further, by rotating the DC motor 14 in the direction indicated by the arrow F, the partially-cut-out gear section 17*b* of the intermediate sheet feeding gear 17 and the feeding roller gear 9*a* intermittently engage with each other through the intermediation of the motor worm gear 15 and the feeding wheel gear 16 to rotate in this condition, thereby driving the feeding roller 9 so as to feed the recording sheet. This recording sheet feeding operation is performed each time the carriage 2, which is driven by the lead screw 6, reaches a position close to either end of its range of movement, that is, each time the recording of one line is completed.

The recording means records an ink image on the recording sheet fed by the feeding means. This recording apparatus uses the ink-jet recording system, in which recording is performed by using ink ejected from the recording heads 3 (3' and 3"). That is, the recording heads of this apparatus are equipped with minute liquid outlets (orifices), liquid paths, energy actuating sections provided in a part of the liquid paths, and an energy generating means for generating a droplet formation energy that is to be applied to the liquid held in the energy actuating sections.

This energy may be generated by various systems, such as a system using electromechanical transducers like piezoelectric elements, a system in which liquid droplets are ejected by the action of heat generated through application of electromagnetic waves like a laser beam to the ink, a system in which the liquid is ejected when it is heated by electrothermal conversion members, such as heat generation elements having heat generation resistors, etc.

Above all, in a recording head used in the ink-jet recording system, in which liquid is ejected by heat energy, liquid outlets (orifices) for forming droplets of recording liquid to be ejected can be arranged at a high density, thereby making a high-resolution recording possible. In particular, a recording head using electrothermal conversion members as the energy generation means is advantageous in that it can be easily formed in a small size. In addition, such a recording head enables the full utilization of the merits of IC techniques, microprocessing techniques, etc., which have recently become more advanced and the reliability of which has been much improved. Moreover, such a recording head can be easily mounted at a high density and manufactured at a low production cost.

Referring to FIG. 3, numeral 18 indicates a flexible printed circuit board, which is attached to the carriage 2 at two positions thereof and which supplies the recording heads 3 (3' and 3") with image signals and electric power. The flexible circuit board 18 is electrically connected to the recording heads 3 (3' and 3") through two set levers 19, and to a control circuit (not shown) through a printed circuit board 20.

Numeral 21 indicates a home position detector for detecting the home position (the recording start position) of the carriage 2. The home position detector 21 consists of a transmission-type photo sensor. The home position detector 21 is connected to the printed circuit board 20 and is adapted to detect a home position of the carriage 2 in accordance with whether either a rib 4*b* or 4*c*, provided on the frame 4, is placed in a groove of the detector 21 or not. More specifically, when the carriage 2 is moving in the direction indicated by the arrow I, the home position is detected by means of the rib 4*c*, and when it is moving in the direction indicated by the arrow H, by means of the rib 4*b*. A recording start position detection signal, which is emitted from the home position detector 21, is transmitted to the control circuit (not shown) by way of the printed circuit board 20.

Figure 4:
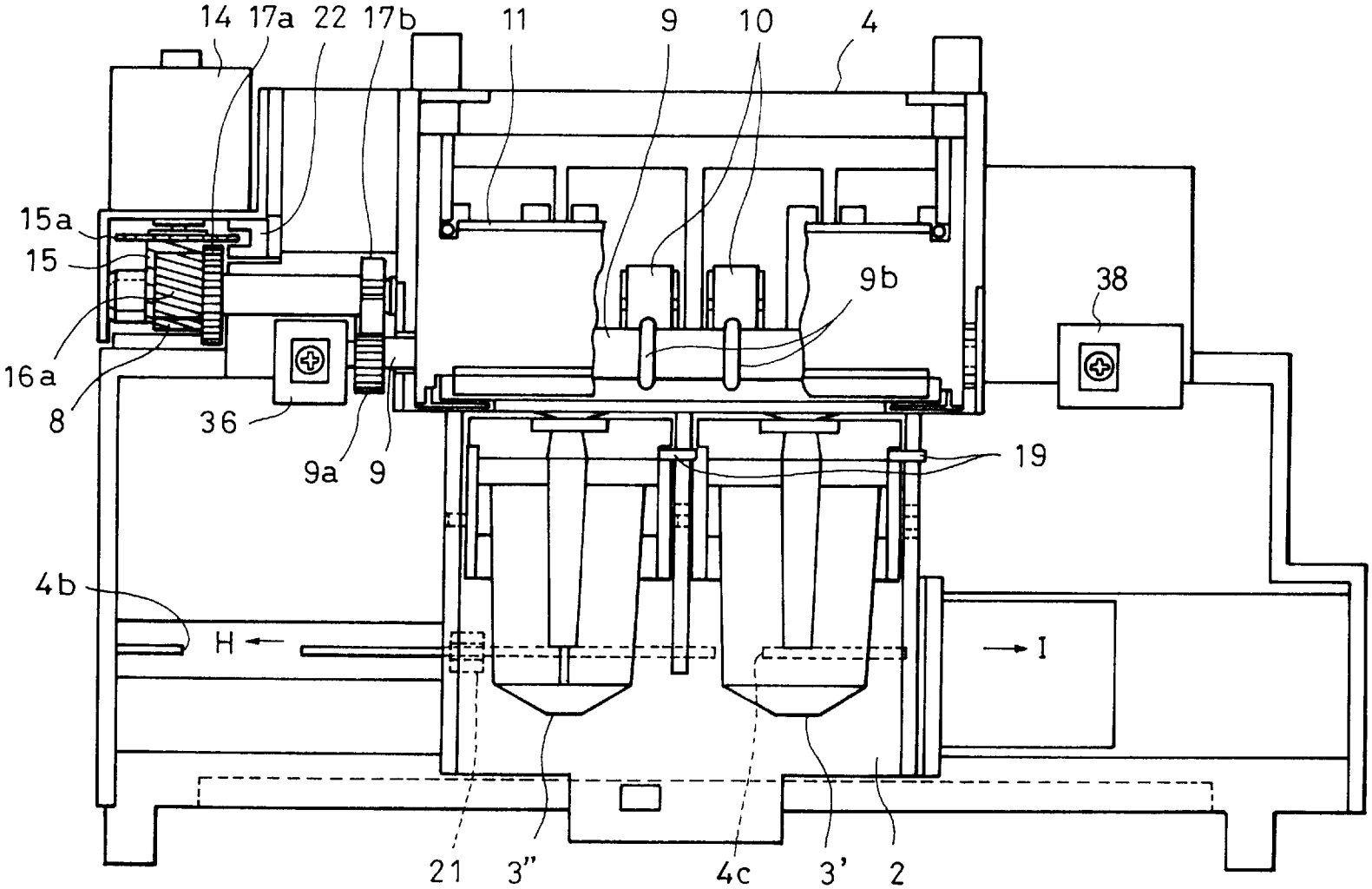
FIG. 4 is a plan view of the recording apparatus.

As shown in FIG. 4, an encoder slit disc 15*a* is integrally attached to the motor worm gear 15, and slit sections formed in the encoder slit disc 15*a* pass by a groove of an ejection signal detector 22, which consists of a transmisson-type photo sensor and is electrically connected to the control circuit (not shown).

Further, referring to FIG. 1, numerals 35, 36, 37 and 38 indicate ink absorbing sections, which absorb ink ejected from the recording heads 3' and 3". In this ink-jet recording apparatus, a preliminary ejection process is conducted in which ink is ejected from the ejection outlets of the recording heads 3' and 3" prior to recording in order to recover the normal ink ejecting condition of these heads. In this preliminary ejection process, the recording heads 3' and 3" are caused to eject a predetermined amount of ink prior to recording when they are at predetermined positions (in predetermined ranges) in order to remove any ink sticking to the heads or any ink excessively viscous or mingled with bubbles, thereby eliminating the causes of recording defects, such as defective dots or displaced dots. The preliminary ejection process, described above, is generally performed when the power of the recording apparatus is turned on, or when recording is performed for the first time during a predetermined period of time after the power is turned on. In the preliminary ejection process, ink is ejected toward the ink absorbing sections 35, 36, 37 and 38, arranged at predetermined positions on the apparatus body 1, so as to cause the ink to be absorbed by these ink absorbing sections.

Figure 5:
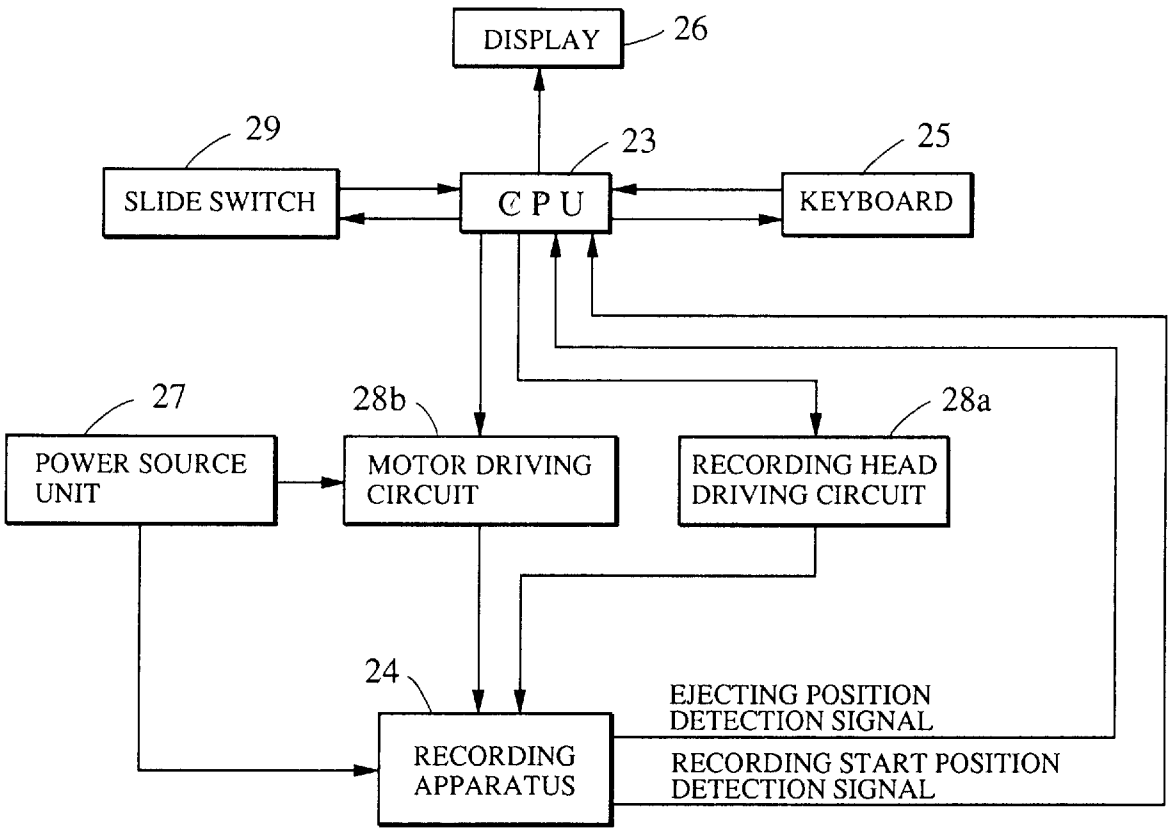
FIG. 5 is a block diagram showing the control system of the recording apparatus.

Next, referring to FIG. 5, the configuration of a recording system comprised of a recording apparatus as described above, indicated at 24, and other peripheral apparatuses, will be described. Numeral 23 indicates a CPU for controlling the recording apparatus 24; numeral 25 indicates a keyboard which includes a ten-key device, function keys, etc. and to which various commands and values are input; numeral 27 indicates a power source unit for supplying power to the recording apparatus 24 and to a motor driving circuit 28*b*. Driving circuit 28*a*, which serves as the recording head driving circuit, drives the recording heads 3 (3' and 3") to cause them to eject ink in accordance with image information to be recorded; and numeral 29 indicates a slide switch, which is electrically connected to the CPU 23 and adapted to select between two modes, a mode in which the two recording heads 3 (3' and 3") use ink of the same color and a mode in which they use inks of different colors.

Two kinds of signals, an ejecting position detection signal, output from the ejection signal detector 22, and a recording start position detection signal, output from the home position detector 21, are input from the recording apparatus 24 to the CPU 23.

Next, the recording operation of the above-described recording apparatus will be explained with reference to the signal timing charts of FIGS. 6 and 7.

When the DC motor 14 is started by applying voltage thereto, the ejecting position detection signal is generated by the encoder slit disc 15*a*, integrally attached to the motor worm gear 15. This signal is generated in one-to-one correspondence with each dot column of a dot matrix.

Figure 6:
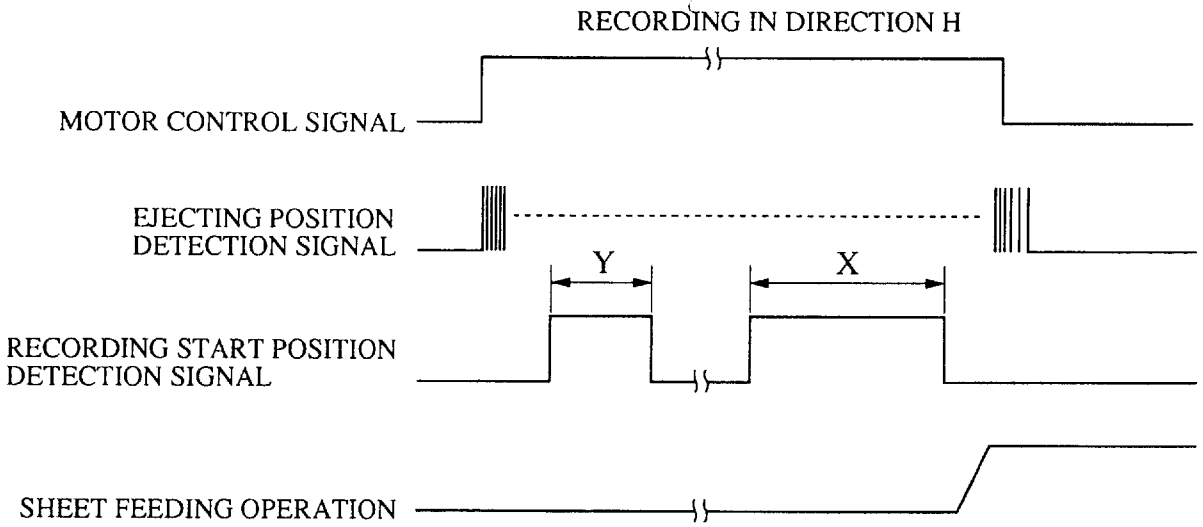
FIG. 6 is a timing chart illustrating the operations of different sections of the apparatus.

When the DC motor 14 is started to cause the motor worm gear 15 to rotate, the carriage 2 starts to move from the right-end position shown in FIG. 1, in the direction indicated by the arrow H (see FIG. 6).

As soon as the home position detector 21 (see FIG. 4), fixed to the carriage 2, passes by the rib 4*c*, the recording start position detection signal is generated. Upon receiving this recording start position detection signal, the CPU 23 selectively outputs recording signals to the recording heads 3 in synchronism with the ejecting position detection signal, whereby recording is performed in the direction indicated by the arrow H of FIG. 1.

In this embodiment, when performing recording in one direction (recording one line of information), the recording signals are supplied from the CPU 23 to only one of the two recording heads 3. When the recording in the direction indicated by the arrow H is completed, the CPU 23 counts the number of pulses of the ejecting position detection signal, and, when it has counted a predetermined number of pulses, stops the supply of power to the DC motor 14. At this stage, the recording sheet feeding operation has been completed, as stated above, and the carriage 2 stops at the left-hand end position of FIG. 1.

Figure 7:
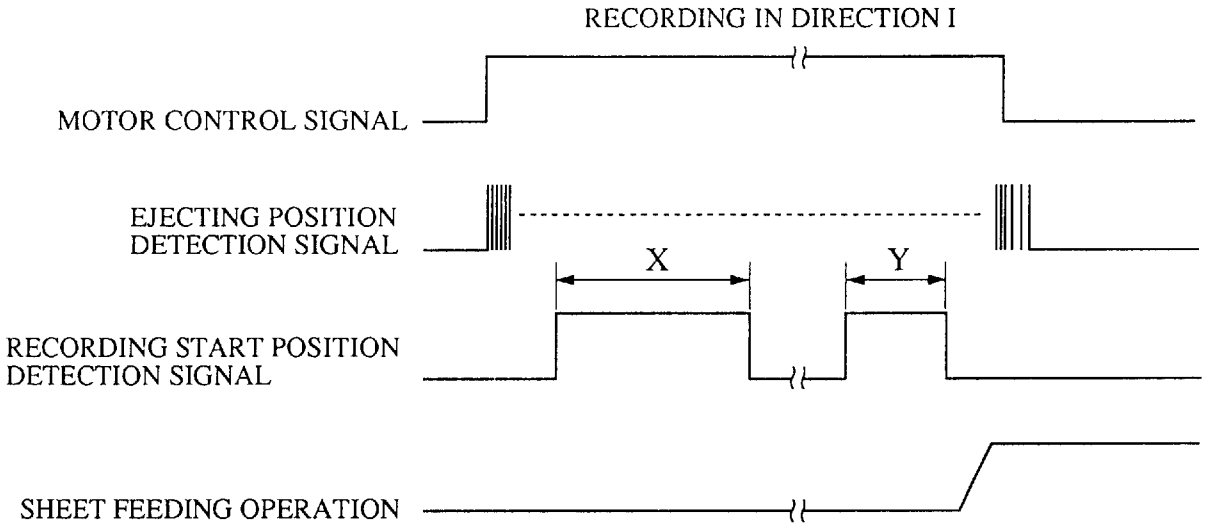
FIG. 7 is another timing chart illustrating the operations of different sections of the apparatus.

When the DC motor 14 is started again, the carriage 2 starts to move from the left-end portion of FIG. 1 in the direction indicated indicated by the arrow I (see FIG. 7). Simultaneously with the start of the DC motor 14, an ejecting position detection signal is generated. In synchronism with the signal generation, recording signals are selectively output from the CPU 23, whereby recording is performed in the direction indicated by the arrow I of FIG. 1. When the recording in the direction indicated by the arrow I has been completed in the manner as described above, the CPU 23 counts the number of pulses of the ejecting position detection signal, and, when it has counted a predetermined number of pulses, stops the supply of power to the DC motor 14. At this time, the recording sheet feeding operation has been completed, as stated above, and the carriage 2 stops at the right-end portion of FIG. 1.

By repeating the above-described operations, recording is performed on the recording sheet.

It is necessary for the CPU 23 to make a judgment as to whether the carriage 2 is at the left-hand end or the right-hand end position. This judgment can be made, for example, by supplying electricity to the DC motor 14 when the power source of the system is turned on or when a particular key is depressed. The rib 4*b*, shown in FIG. 4, is shaped such that the ejecting position detection signal differs between the directions H and I, as shown in FIGS. 6 and 7. When the signal is of the Y→X type shown in FIG. 6, the CPU 23 concludes that the carriage is moving in the direction indicated by the arrow H, and, when the signal is of the X→Y type shown in FIG. 7, the CPU 23 concludes that the carriage is moving in the direction indicated by the arrow I.

By counting the number of pulses of the ejecting position detection signal, the discrimination between the pulse signals X and Y can be correctly effected even when the rotating speed of the DC motor 14 differs.

Figure 8:
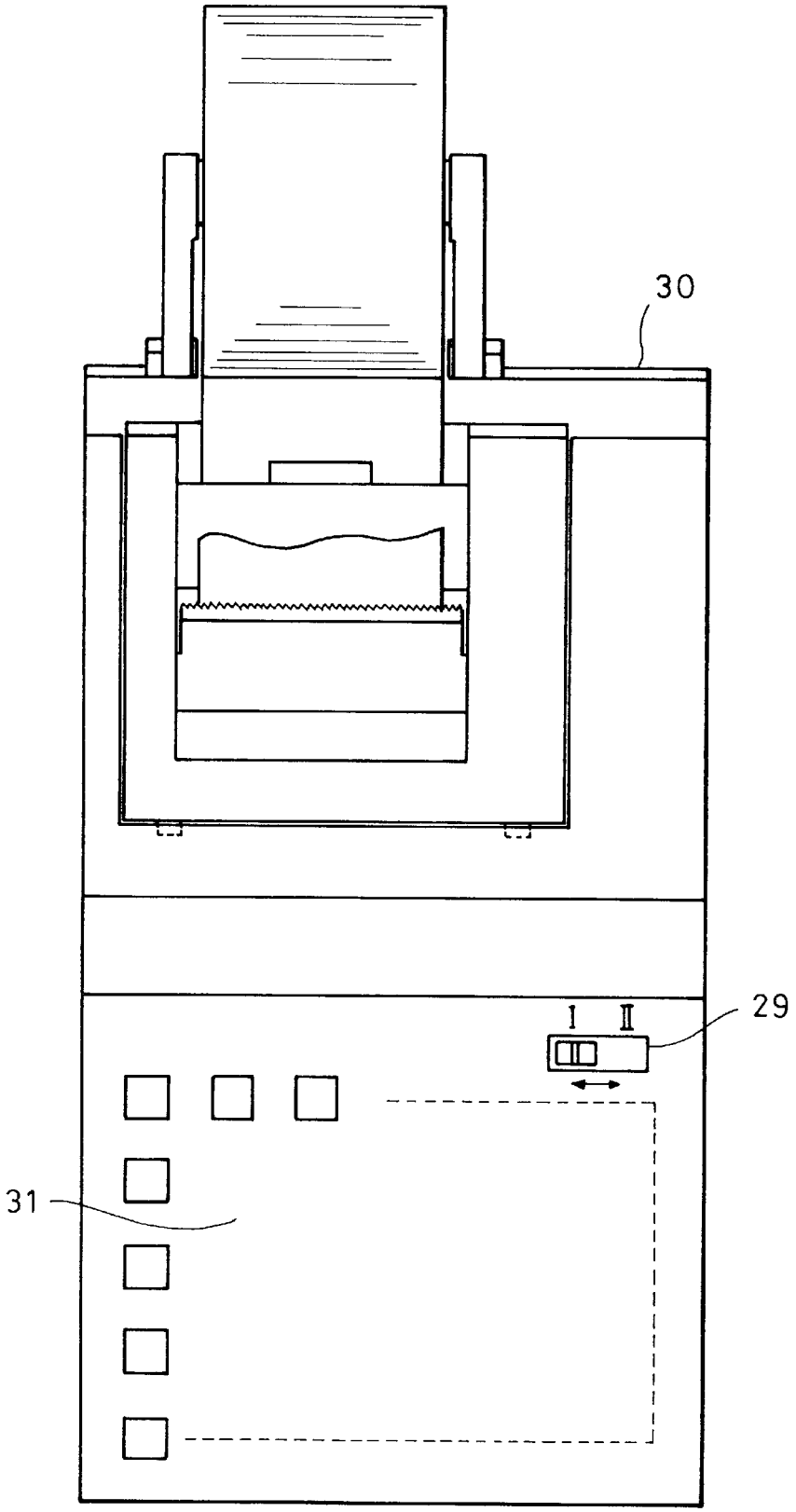
FIG. 8 is an explanatory diagram showing the outward appearance of the recording apparatus.

FIG. 8 is a plan view of an electronic apparatus 30 on which the recording apparatus of this embodiment is mounted. The slide switch 29, mentioned above, is provided on the electronic apparatus 30 and directly connected to the CPU 23 to make selection between two positions (I, II) possible. The slide switch 29 is used to select between two modes, a mode in which the two recording heads record in the same color and a mode in which they record in different colors. The same color mode corresponds to the position II, and the the different color mode corresponds to the position I. When the recording heads 3 are of different colors, the slide switch 29 is set to the position I. Then, the CPU 23 concludes that the two recording heads 3 are of different colors, and performs recording with either of the recording heads 3 appropriately selected in accordance with the data input through the keyboard 31. The selection of the head to be used is based on a control system which is set beforehand (the normal recording operation).

When, on the other hand, the two recording heads 3 are of the same color, the slide switch 29 is set to the position II. The CPU 23 then concludes that the recording heads 3 are of the same color. When the carriage 2 moves in the direction indicated by the arrow I of FIG. 4, the recording based on the recording signals from the CPU 23 is performed with the recording head 3' which is on the right-hand side (on the same side as the arrow I) as seen in FIG. 4, and, when the carriage 2 moves in the direction indicated by the arrow H, recording is performed with the recording head 3" on the left-hand side (on the same side as the arrow H) in FIG. 4.

Figure 9:
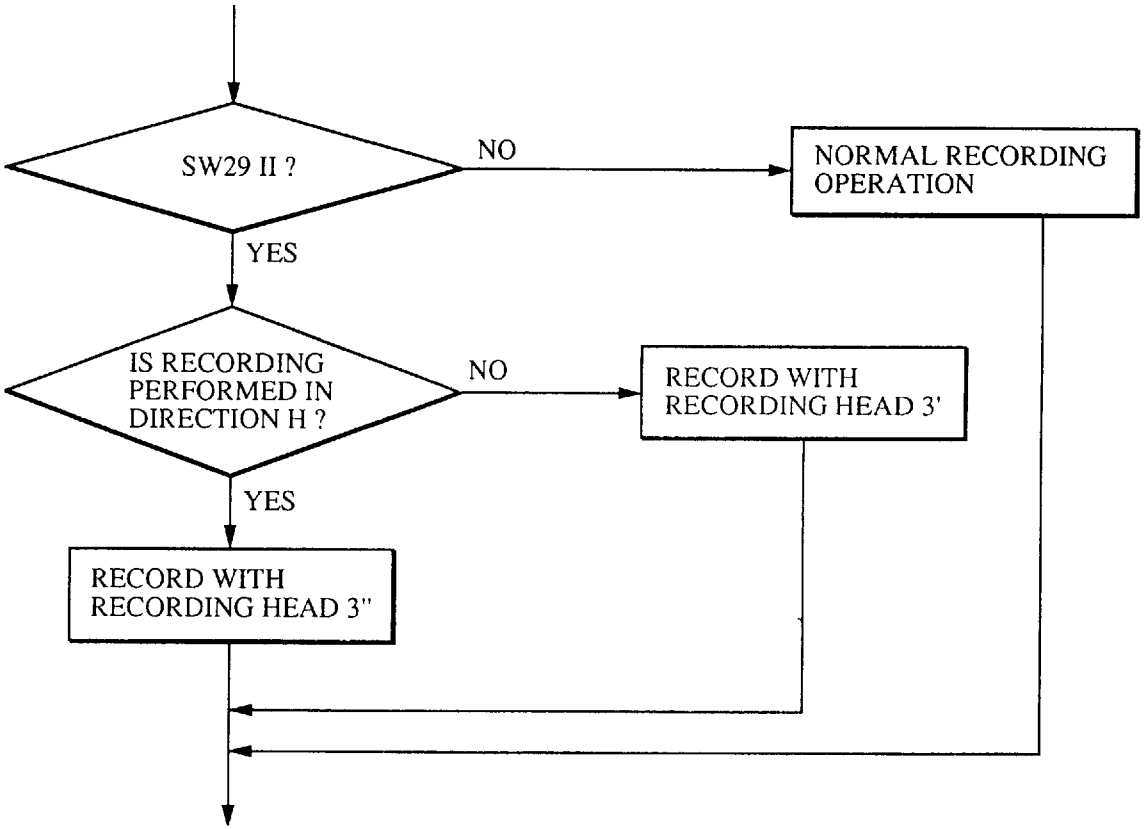
FIG. 9 is a flowchart illustrating recording control operations.

That is, the recording signals are transmitted from the CPU 23 in such a way that the recording heads 3' and 3" are alternately used line by line. More specifically, the CPU 23 is set beforehand such that recording is appropriately performed with the front recording head with respect to the direction in which the carriage moves. The above-described operations are shown in the flowchart of FIG. 9.

Next, the preliminary ejection process for the recording heads 3 will be described. In conventional recording apparatuses, the recording heads are stopped at predetermined positions each time the preliminary ejection process is performed, resulting in a waste of time. In this embodiment, the preliminary ejection process is performed as described below. Here, the process will be first described with reference to the case where it is performed when the power source is turned on. When the recording start position detection signal is of the Y→X type as shown in FIG. 6, the CPU 23 concludes that the carriage 2 and the recording heads 3 are moving in the direction indicated by the arrow H. When the moving direction of the carriage 2 changes to the one indicated by the arrow I, and the number of pulses of the ejecting position detection signal X, counted from the rise of the recording start position detection signal, reaches a predetermined number corresponding to predetermined positions of the ink absorbing sections 37 and 38, the recording heads 3' and 3" perform preliminary ejection by ejecting a predetermined amount of ink toward the ink absorbing sections 38 and 37, respectively, while the carriage 2 continues to move in the direction indicated by the arrow I. When another predetermined number of pulses of the ejecting position detection signal has been counted, the power supply to the DC motor 14 is turned off to terminate the recording operation.

When, on the other hand, the recording start position detection signal is of the X→Y type as shown in FIG. 7, the CPU 23 concludes that the carriage 2 and the recording heads 3 are moving in the direction indicated by the arrow I of FIG. 1. When the moving direction of the carriage 2 changes to the one indicated by the arrow H, and a predetermined number of pulses of the ejecting position detection signal, counted from the rise of the recording start position detection signal Y, has reached a predetermined number corresponding to previously set positions of the ink absorbing sections 35 and 36, the recording heads 3' and 3" perform preliminary ejection by ejecting a predetermined amount of ink toward the ink absorbing sections 35 and 36, respectively, while the carriage 2 continues to move in the direction indicated by the arrow H. When another predetermined number of pulses of the ejecting position detection signal has been counted, the power supply to the DC motor 14 is stopped to terminate the recording operation.

The timing with which the DC motor 14 is turned OFF is set beforehand such that the recording heads 3' and 3" stop at positions opposed to the ink absorbing sections 35 and 36, respectively, or at positions opposed to the ink absorbing sections 37 and 38, respectively.

Next, the case in which preliminary ejection is performed for the first time during a predetermined length of time after the power source is turned on will be described. When the recording heads 3 are at the right-end position shown in FIG. 1, the recording heads 3' and 3" perform preliminary ejection by ejecting a predetermined amount of ink toward the ink absorbing sections 38 and 37, respectively, simultaneously with the power supply to the DC motor 14 while the carriage 2 is moving in the direction indicated by the arrow H. When the recording heads are at the left-end portion, the recording heads 3' and 3" perform preliminary ejection by ejecting a predetermined amount of ink toward the ink absorbing sections 35 and 36, respectively, simultaneously with the power supply to the DC motor 14 while the carriage 2 is moving in the direction indicated by the arrow I. After that, recording is performed on the recording sheet when the recording start position detection signal has risen.

In accordance with the above-described construction, there is provided a means for selecting between the two modes, the mode in which the recording heads record in the same color and the one in which they record in different colors. When in the same color mode, the recording heads are alternately used line by line so that they can be used substantially the same number of times. This enables the service life of the ink in one recording head to be as close as possible to that of the ink in the other recording head, so that the recording heads can be replaced by new ones practically at the same time, thereby making it possible to use ink in an efficient manner.

Further, prior to recording on the recording sheet, the carriage 2 is operated to move the recording heads 3 along the width dimension of the recording sheet, and, while the heads are thus moving, they are caused to perform preliminary ejection by a predetermined amount with respect to the ink absorbing sections 35 and 36, or 37 and 38, thereby eliminating the waste of time involved in conventional recording apparatuses, in which preliminary ejection is performed after stopping the recording means.

[Second Embodiment]

Figure 10:
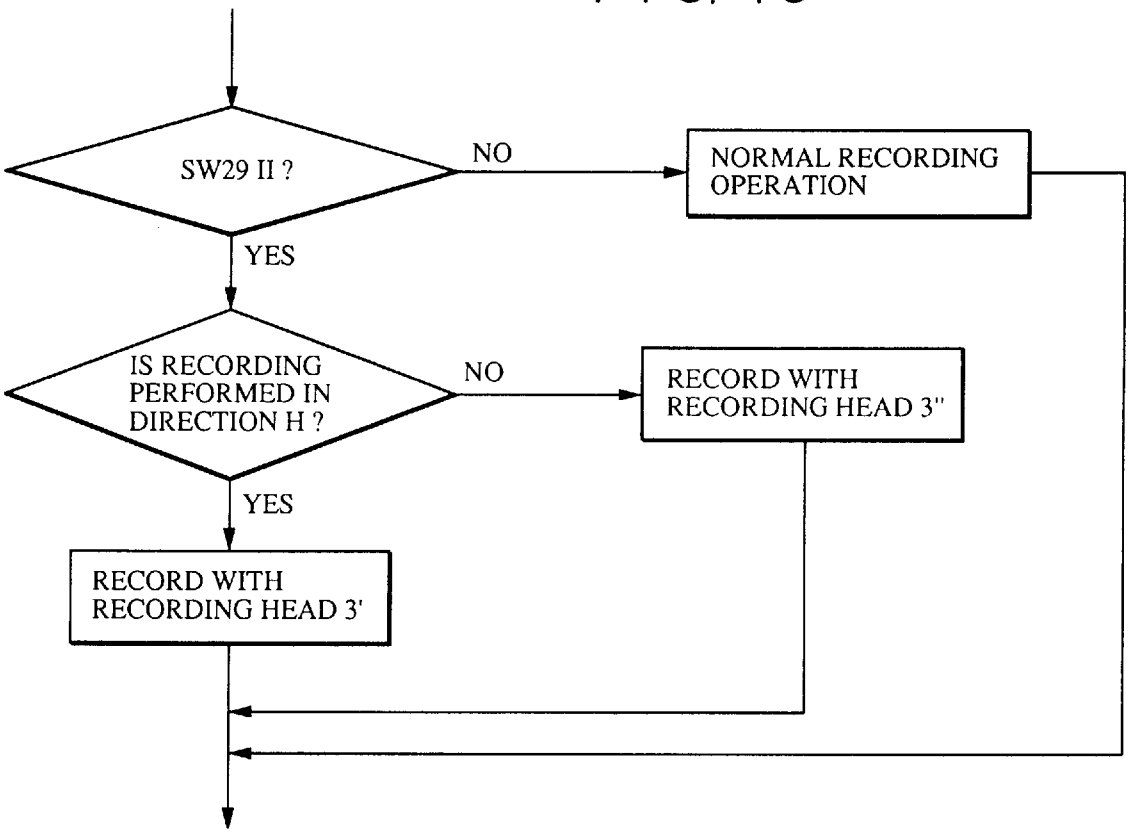
FIG. 10 is a flowchart illustrating recording control operations according to a second embodiment of the present invention.

While in the first embodiment recording was performed by alternating the two recording heads 3, using the front head in either of their moving directions, it is also possible to adopt an arrangement as shown in the flowchart of FIG. 10, in which, when the slide switch 29 is at the position II, the CPU 23 controls recording by alternating the recording heads, using the back one in either of their moving directions, i.e., the recording head 3" when the carriage 2 is moving in the direction indicated by the arrow I, and the recording head 3' when the carriage is moving in the direction indicated by the arrow H.

[Third Embodiment]

The first and second embodiments have been described with reference to a recording apparatus equipped with a recording means for performing two-direction (to the right and left) recording. The third embodiment of this invention concerns a case in which a recording apparatus whose carriage 2 performs recording solely through a movement in a single, predetermined direction, alternately using two recording heads of the same color.

Figure 11:
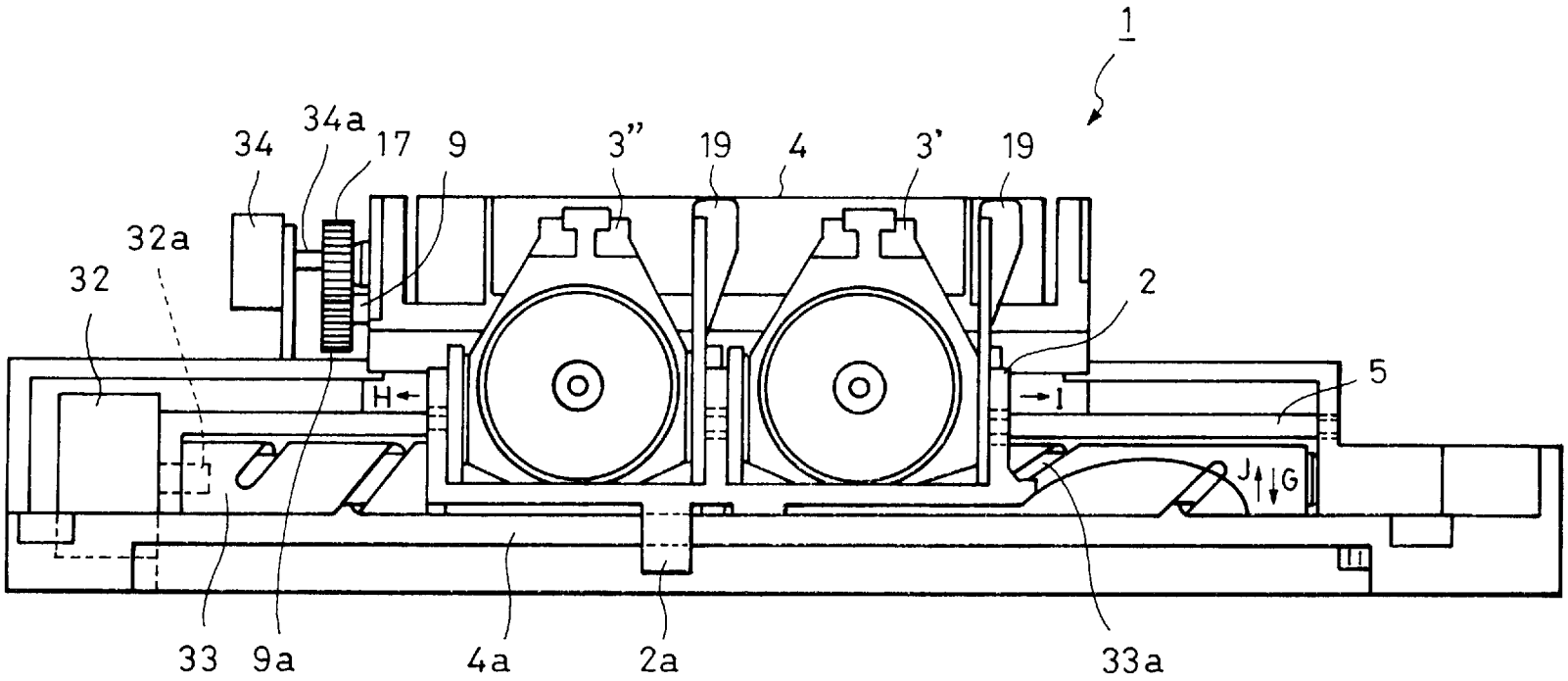
FIG. 11 is a front view of a recording apparatus according to a third embodiment of the present invention.

FIG. 11 shows a front view of an ink-jet recording apparatus. In the drawing, the components which are the same as those of the first embodiment are indicated by the same reference numerals, and a description of such components will be omitted. Numeral 32 indicates a carriage driving motor, which consists of a pulse motor. A shaft 32*a* of the carriage driving motor 32 is fitted into the left-end portion of a one-direction lead screw 33. The motor 32 is secured to the apparatus body 1 so that the motor shaft 32*a* may rotate integrally with the one-direction lead screw 33. A one-directional screw groove 33*a* is formed on the surface of the one-direction lead screw 33.

Numeral 34 indicates a recording sheet feeding motor, which consists of a pulse motor. A motor shaft 34*a* of the recording sheet feeding motor 34 is fitted into the central portion of the intermediate sheet feeding gear 17, which is engaged with the feeding roller gear 9*a* provided at the left-hand end of the feeding roller 9.

By the normal or reverse rotation of the carriage driving motor 32, the one-directional lead screw 33 rotates in the direction indicated by the arrow J or the direction indicated by the arrow G of FIG. 11 to move in the direction indicated by the arrow H or the direction indicated by the arrow I.

In this embodiment, recording operation is performed only when the carriage 2 moves in the direction indicated by the arrow H. When the carriage 2 moves in the direction indicated by the arrow I, the recording sheet feeding motor 34 is rotated so as to rotate the feeding roller 9 by a predetermined amount to feed the recording sheet. The recording operation is performed by alternately driving the two recording heads 3' and 3" of the same color when the carriage 2 is moving in the direction indicated by the arrow H.

[Fourth Embodiment]

Figure 12:
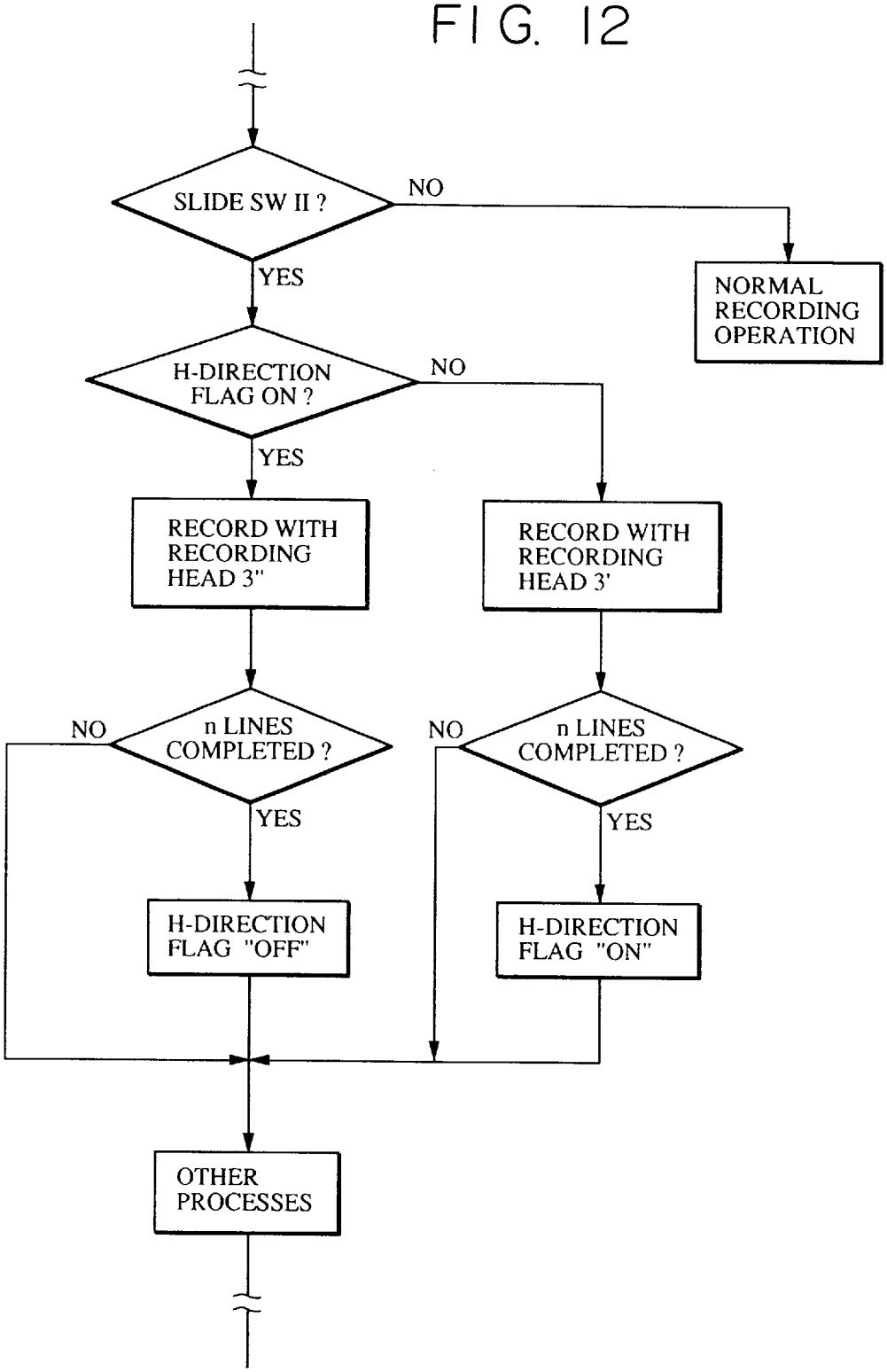
FIG. 12 is a flowchart illustrating recording control operations according to a fourth embodiment of the present invention.

The first through third embodiments have been described with reference to the case where recording is performed by alternately using, line by line, the two recording heads 3' and 3" holding ink of the same color. In this embodiment, as shown in the flowchart of FIG. 12, a predetermined number of lines (n lines) are first recorded by one recording head, and then another n lines are recorded by the other recording head; by repeating these operations, it is possible for the recording heads 3' and 3" to be used the same number of times. More specifically, the two recording heads are alternately used, for example, such that n lines of information are first recorded by the recording head 3" while moving the carriage 2 in the direction indicated by the arrow H; then, another n lines of information are recorded by the recording head 3' while moving the carriage 2 in the direction indicated by the arrow I.

[Fifth Embodiment]

Figure 13:
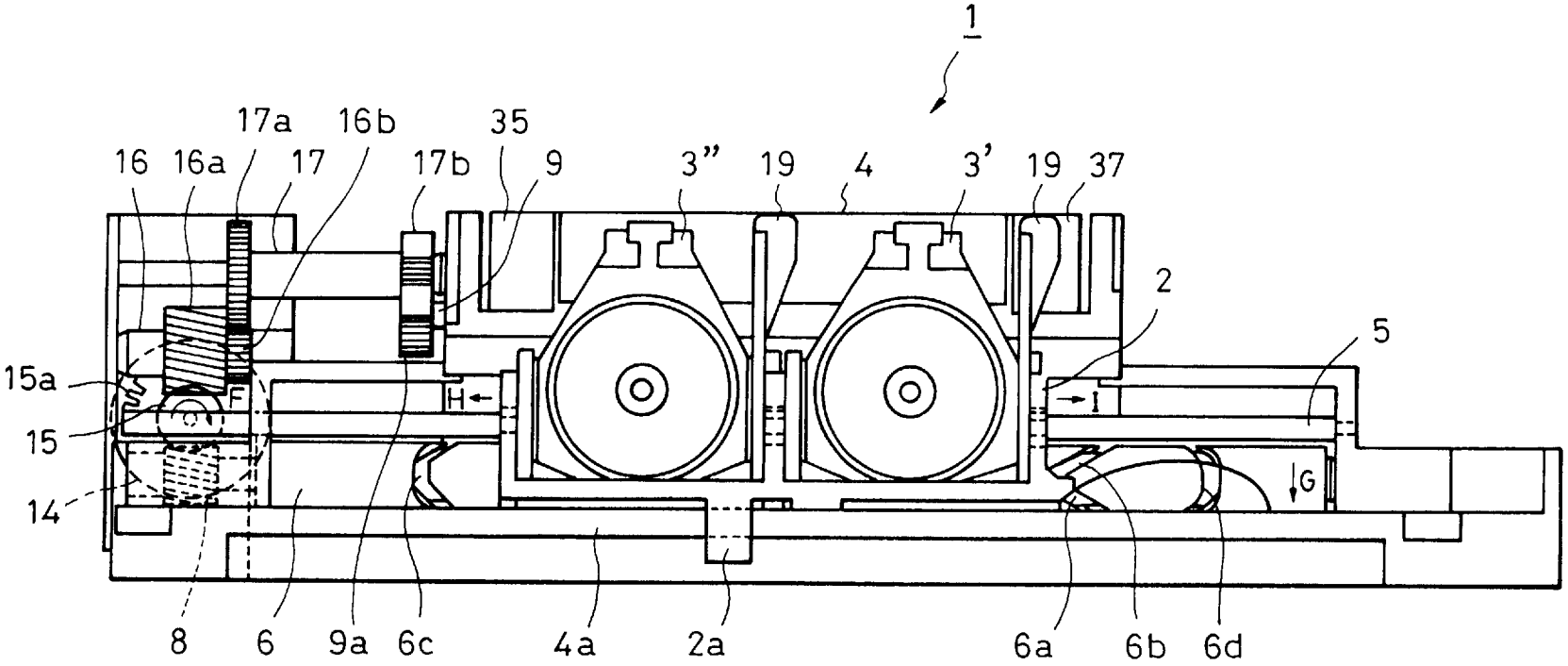
FIG. 13 is a front view showing a recording apparatus according to a fifth embodiment of the present invention.

In this embodiment, the ink absorbing sections 36 and 38 at the left and right ends in the first embodiment are omitted. FIG. 13 is a front view showing an ink-jet recording apparatus. The general construction of this apparatus is the same as that of the first embodiment, and the components which are the same as those of the first embodiment are indicated by the same reference numerals, and a description of such components will be omitted. In the following, the preliminary ejection process for the recording heads in this embodiment will be described.

When, after the power source is turned on, the recording start position detection signal is of the Y→X type, as shown in FIG. 6, the CPU 23 concludes that the carriage 2 and the recording heads 3 are moving in the direction indicated by the arrow H. When the moving direction of the carriage 2 is changed to the direction indicated by the arrow I, the recording start position detection signal X rises, and, simultaneously with the signal rise, the counting of the number of pulses of the ejecting position detection signal is started. The respective requisite numbers of pulses for the recording heads 3' and 3" to reach the position of the ink absorbing section 37, shown in FIG. 13, are set beforehand. First, when the preset number of pulses corresponding to the interval required for the recording head 3' to reach the position of the ink absorbing section 37 has been counted, only the recording head 3' performs preliminary ejection while the carriage 2 is moving in the direction indicated by the arrow I. Then, when the preset number of pulses corresponding to the interval required for the recording head 3" to reach the position of the ink absorbing section 37 has been counted, only the recording head 3" performs preliminary ejection while the carriage 2 is moving in the direction indicated by the arrow I.

When the recording start position detection signal is of the X→Y type, as shown in FIG. 7, the CPU 23 concludes that the carriage 2 and the recording heads 3 are moving in the direction indicated by the arrow I. When the moving direction of the carriage 2 is changed to the direction indicated by the arrow H, the recording start position detection signal Y rises, and, simultaneously with the signal rise, the counting of the number of pulses of the ejecting position detection signal is started. The respective requisite numbers of pulses for the recording heads 3' and 3" to reach the position of the ink absorbing section, shown in FIG. 13 are set beforehand. First, when the preset number of pulses corresponding to the interval required for the recording head 3" to reach the position of the ink absorbing section 35 has been counted, only the recording head 3" performs preliminary ejection while the carriage 2 is moving in the direction indicated by the arrow H. Then, when the preset number of pulses corresponding to the interval required for the recording head 3' to reach the position of the ink absorbing section 35 has been counted, only the recording head 3' performs preliminary ejection while the carriage 2 is moving in the direction indicated by the arrow H.

In accordance with the above-described construction, the waste of time involved in the preliminary ejection process in the prior art is eliminated. Further, since the number of ink absorbing sections may be half that of the first embodiment, the number of parts can be reduced, thereby achieving a reduction in cost.

[Sixth Embodiment]

Figure 14:
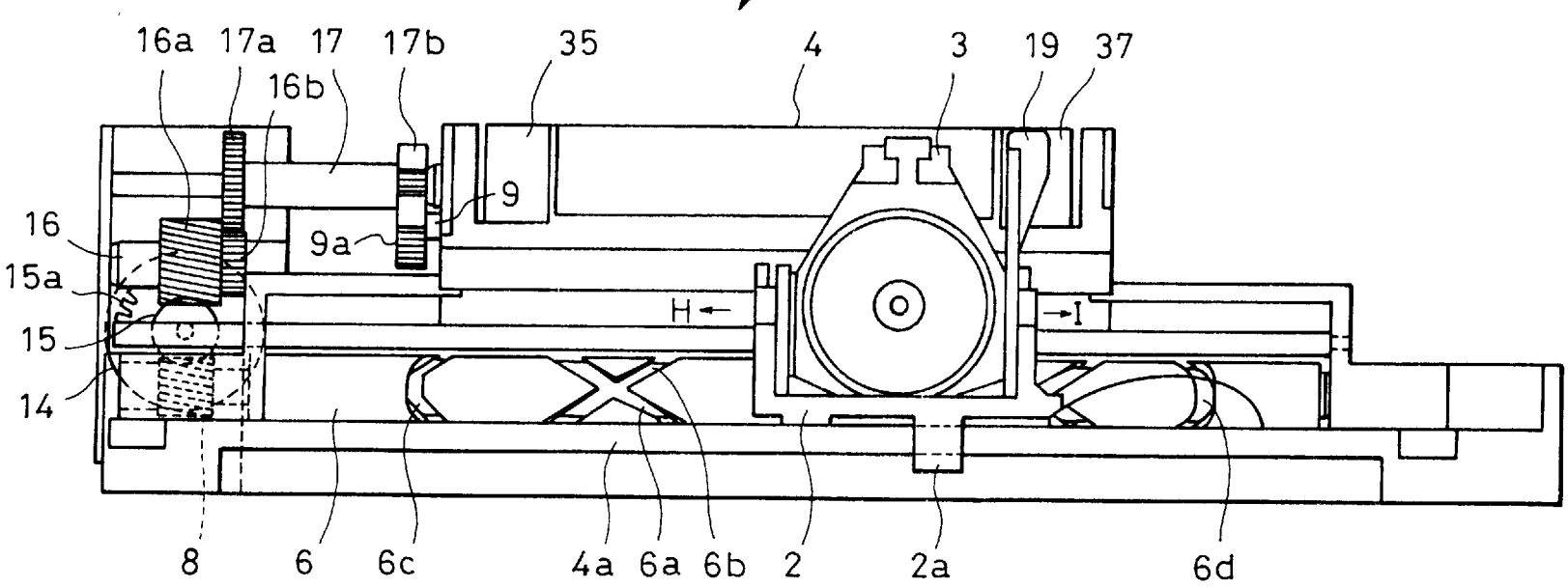
FIG. 14 is a front view showing a recording apparatus according to a sixth embodiment of the present invention.

While the fifth embodiment has been described with reference to an apparatus using two recording heads 3' and 3", it is also possible, as shown in FIG. 14, to execute a preliminary ejection process similar to that in the fifth embodiment with a recording apparatus which can perform two-direction recording by using a single recording head 3. The apparatus shown in FIG. 14 has a general construction that is substantially the same as that of the first embodiment. Thus, in the drawing, the same components as those of the first embodiment are indicated by the same reference numerals, and a description of such components will be omitted.

[Seventh Embodiment]

Figure 15:
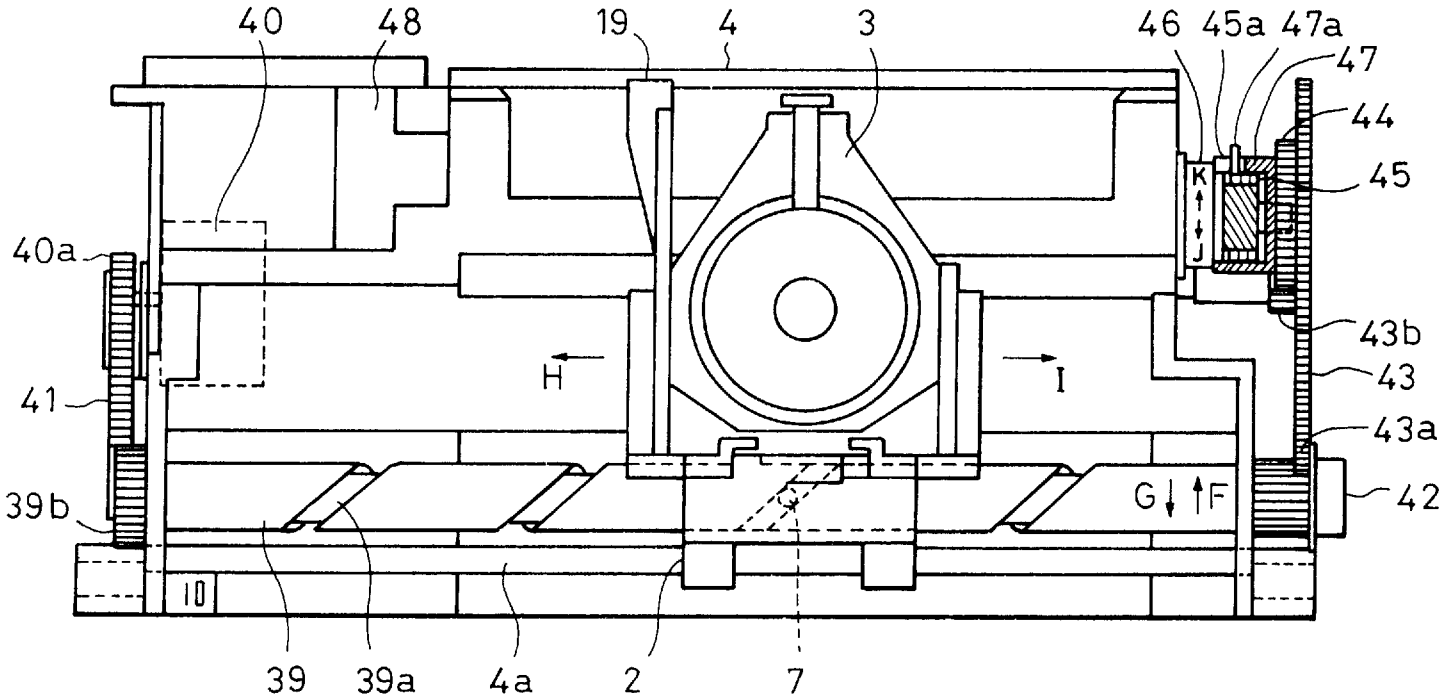
FIG. 15 is a front view showing a recording apparatus according to a seventh embodiment of the present invention.

While the first, fifth and sixth embodiments have been described with reference to a recording apparatus which is capable of reciprocative (two-direction) recording by using the two-directional lead screw 6, the above-described means (2) functions effectively also in a recording apparatus capable of one-direction recording. FIG. 15 shows a front view of an ink-jet recording apparatus. In the drawing, the components which are the same as those of the first embodiment are indicated by the same reference numerals, and a description of such components will be omitted.

Referring to FIG. 15, numeral 39 indicates a one-directional lead screw having on its surface a screw groove 39*a* in only one direction. Numeral 40 indicates a step motor serving as the drive source, which supplies driving forces to the above-mentioned one-directional lead screw 39 and to a feeding roller described below. The step motor 40 has a motor gear 40*a* which is engaged with a gear section 39*b* at the left-hand end of the lead screw 39 through the intermediation of a transmission gear 41. A sheet feeding gear 42 is fastened to the right-hand end of the one-directional lead screw 39. Numeral 43 indicates an intermediate sheet feeding gear, which has a gear section 40*a* engaged with the sheet feeding gear 42 and a gear section 40*b* engaged with a clutch gear 44, which is integrally formed with a boss 45 and rotatably mounted on the rotating shaft of a feeding roller 46. A clutch spring 47 is wound around the right-end portion of the feeding roller 46, and one end 47*a* of the clutch spring 47 is engaged with a groove 45*a* formed on the boss 45. When the clutch gear 44 receives a driving force causing it to rotate in the direction indicated by the arrow K, it rotates in such a way that the clutch spring 47 is tightened, thereby enabling a driving force to be transmitted to the feeding roller 46. When the clutch gear 44 receives a driving force causing it to rotate in the direction indicated by the arrow J, it rotates in such a way that the clutch 47 is loosened, so that no driving force is transmitted to the feeding roller 46.

The above-mentioned one-directional lead screw 39 rotates in the direction indicated by the arrow G or F by the normal or reverse rotation of the step motor 40, and the screw pin 7, which is provided on the carriage 2, becomes engaged with the screw groove 39*a* so as to move along the screw groove 39*a* as the lead screw 39 rotates, thereby causing the carriage 2 to reciprocate in the directions of H and I. More specifically, when the one-directional lead screw 39 rotates in the direction indicated by the arrow F, the carriage 2 moves in the direction indicated by the arrow H, and, when the one-directional lead screw 39 rotates in the direction indicated by the arrow G, the carriage 2 moves in the direction indicated by the arrow I.

In this embodiment, recording is performed only when the carriage 2 moves in the direction indicated by the arrow I (when the one-directional lead screw 39 rotates in the direction indicated by the arrow G). In this case, the clutch gear rotates so as to cause the clutch spring 47 to become loose, and transmits no driving force to the feeding roller, so that the recording sheet feeding operation is not performed.

When the recording operation is completed and the carriage 2 has moved by a predetermined amount in the direction indicated by the arrow I, the step motor 40 reverses its rotating direction to cause the carriage 2 to start to move in the direction indicated by the arrow H (the one-directional lead screw 39 rotates in the direction indicated by the arrow F). At this stage, the clutch gear rotates so as to cause spring 47 to be tightened to transmit a driving force to the feeding roller 46, thereby feeding the recording sheet by a predetermined amount.

In the series of operations described above, the recording head 3 performs preliminary ejection as described above under predetermined conditions when it reaches a position corresponding to an ink absorbing section 48.

[Other Embodiments]

While the ink-jet recording system was adopted as the recording means in the above-described embodiments, it is still more desirable to employ a system in which electricity is supplied to electrothermal conversion members in accordance with recording signals, performing recording by ejecting ink from ejection outlets through growth and shrinkage of bubbles in the ink generated by utilizing film boiling caused in the ink by the heat energy obtained by the electrothermal conversion members.

In this regard, it is desirable to adopt the basic principles as disclosed, for example, in U.S. Pat. Nos. 4,723,129 and 4,740,796. Such a system is applicable to both so-called on-demand type and continuous-type recording apparatuses. The system is especially advantageous when applied to an on-demand type apparatus, in which at least one driving signal corresponding to information to be recorded and causing a rapid temperature rise beyond the nucleate boiling point is applied to electrothermal conversion members arranged in correspondence with liquid (ink) containing sheets, liquid paths, etc., whereby heat energy is generated in the electrothermal conversion members, thereby causing film boiling on the heat actuating surface of the recording head so as to form in the liquid a bubble in one-to-one correspondence with the driving signal. Through growth and shrinkage of this bubble, liquid is ejected through an ejection outlet to form at least one droplet. It is more desirable for this driving signal to be in the form of pulses since appropriate growth and shrinkage of bubbles can then be effected instantaneously, realizing particularly excellent liquid ejection.

Suitable examples of the driving signal in the form of pulses are described in U.S. Pat. Nos. 4,463,359 and 4,345,262.

Further, by adopting the conditions as disclosed in U.S. Pat. No. 4,313,124 regarding the temperature rise ratio on the heat actuating surface, it is possible to effect still more excellent recording.

Apart from the recording head constructions as disclosed in the above-mentioned patent specifications, in which ejection outlets, liquid paths and electrothermal conversion members are combined (linear or rectangular liquid paths), the present invention covers constructions as disclosed in U.S. Pat. Nos. 4,558,333 and 4,459,600, in which the heat actuating section is arranged in a bent region.

Further, the present invention can also be effectively applied to the construction as disclosed in Japanese Patent Laid-Open No. 59-123670, in which common slits are used as the ejecting sections of electrothermal conversion members, or the construction as disclosed in Japanese Patent Laid-Open No. 59-138461, in which openings absorbing heat energy pressure waves are arranged in correspondence with the ejecting sections. Thus, the present invention makes it possible to perform recording reliably and effectively irrespective of the type of recording head.

Furthermore, the present invention is also applicable to a serial-type recording head which is fastened to the carriage, or to a replaceable, chip-type recording head which is attached to the carriage so that it can be electrically connected with the apparatus body and supplied with ink therefrom.

Also, it is preferable to additionally provide a means for recovering the functions of the recording head, and other preliminary and auxiliary means since these will further stabilize the effectiveness provided by the present invention. Examples of such means for effecting stable recording include: a capping means for performing a capping operation on the recording head; a cleaning means; a pressurizing or sucking means; and a preliminary heating means of an electrothermal conversion type, or a heating means consisting of other types of heating elements or a combination thereof.

Further, there is no particular restriction regarding the type and number of recording heads mounted on the carriage. For example, it is possible to provide only one recording head for ink of a single color, or a plurality of recording heads for inks of different colors and densities. For instance, apart from the recording mode in which only a principal color, e.g., black, is used, it is possible to adopt a recording mode in which recording is performed by using a combination of a plurality of recording heads of different colors. Further, it is also possible to apply the present invention to an apparatus which is capable of at least either multi-color recording using different colors or full-color recording using mixed colors.

Furthermore, while the above embodiments have been described with reference to the case in which liquid ink is used, it is also possible to employ a solid ink which solidifies at room temperature or lower and which softens or liquefies at room temperature. In the ink-jet recording system, a solid ink may be used since the temperature of the ink in the system is generally controlled so as to be within the range of 30° C. to 70° C. to maintain the viscosity of the ink within the stable ejection range. Thus, a solid ink can be used as long as it liquefies at the time that recording signals are imparted to the heads. Apart from this, the heat energy used for generating droplets may be utilized to liquefy the solid ink, thereby preventing the temperature of the head from rising. Further, by using an ink which solidifies when left to stand, it is possible to prevent the ink from vaporizing. In any case, the present invention is applicable to a recording head using a solid ink which only liquefies when heat energy is applied thereto, for example, an ink which is liquified by the application of heat energy thereto in accordance with recording signals so as to eject liquid ink, or an ink which starts to solidify the moment it reaches the recording sheet.

Such an ink may be held in the liquid or solid state within recesses of a porous sheet or within through-holes so as to face electrothermal conversion members. The most effective system for such an ink is the film boiling system mentioned above.

Further, the ink-jet recording apparatus described above may be used as an image output terminal of an information processing apparatus like a computer, or as a copying apparatus combined with a reader, or, further, as a facsimile apparatus having transmitting and receiving functions.

As described above with reference to its embodiments, in accordance with the present invention, there is provided a means for selecting between a mode in which recording heads record in the same color and a mode in which they record in different colors. In the former mode, the respective numbers of times of use of the recording heads using ink of the same color are substantially equalized by causing them to operate alternately line by line or for a predetermined number of lines. This makes the lengths of the respective service lives of the recording heads as equal as possible to each other, thereby making it possible for the recording heads to be replaced substantially at the same time.

Further, prior to recording on the recording medium, the recording means are moved in the direction of the width of the recording medium so as to cause them to perform preliminary ejection by a predetermined amount with respect to ink absorbing sections, thereby eliminating the waste of time involved in conventional recording apparatuses, in which the preliminary ejection is performed after stopping the recording means.

What is claimed is:

1. A recording apparatus which records on a recording medium with a plurality of recording heads, comprising:

a carriage for carrying the plurality of recording heads, said carriage being movable in a moving direction crossing a direction in which the recording medium is fed;

moving means for moving said carriage in the moving direction;

driving means for driving the recording heads on said carriage moved by said moving means; and control means for, when at least two of the plurality of recording heads are of a same recording color, controlling recording by controlling said moving means to move said carriage and controlling said driving means to alternately drive the recording heads for a predetermined number of lines, wherein one line is recorded in each movement of the recording heads in the moving direction and the predetermined number is greater than one and wherein said control means controls said driving means to alternately drive the recording heads for the predetermined number of lines regardless of image data to be recorded.

2. A recording apparatus according to claim 1, wherein said recording heads comprise ink-jet recording heads which record on a recording medium by ejecting ink through ink ejection outlets.

3. A recording apparatus according to claim 2, wherein said ink-jet recording heads are provided with electrothermal conversion members for generating heat energy for heating ink to eject the ink.

4. A recording apparatus according to claim 3, wherein said ink-jet recording heads eject the ink through said ejection outlets by film boiling caused in the ink by heat energy generated by said electrothermal conversion members.

5. A recording apparatus according to claim 1, wherein, prior to recording by driving said recording heads, said control means effects preliminary ejection by controlling said driving means to cause ink to be preliminarily ejected toward ink absorbing sections while controlling said moving means to move said carriage carrying said recording heads in the moving direction crossing the direction in which said recording medium is fed.

6. A recording apparatus according to claim 1, wherein said carriage mounts the plurality of recording heads so that all of the plurality of recording heads follow a same moving path when said moving means moves said carriage in the moving direction.

7. A printer which performs printing on a printing medium with a plurality of ink-jet heads, said printer comprising:

a carriage for carrying the plurality of ink-jet heads, said carriage being movable in a moving direction crossing a direction in which the printing medium is fed;

moving means for moving said carriage in the moving direction;

driving means for driving the ink-jet heads on said carriage moved by said moving means; and control means for, when at least two of the plurality of ink-jet heads are of a same printing color, controlling printing by controlling said moving means to move said carriage and controlling said driving means to alternately drive the ink-jet heads for a predetermined number of lines, wherein one line is printed in each movement of the ink-jet heads in the moving direction and the predetermined number is greater than one and wherein said control means controls said driving means to alternately drive the ink-jet heads for the predetermined number of lines regardless of image data to be printed.

8. A printer according to claim 7, wherein said ink-jet heads are provided with electrothermal conversion members for generating heat energy for heating ink to eject the ink.

9. A printer according to claim 8, wherein said ink-jet heads eject the ink through ejection outlets by film boiling in the ink caused by heat energy generated by said electrothermal conversion members.

10. A printer according to claim 7, wherein, prior to performing printing by driving said ink-jet heads, said control means effects preliminary ejection by controlling said driving means to cause ink to be preliminarily ejected toward ink absorbing sections while controlling said moving means to move said carriage carrying said ink-jet heads in the moving direction crossing the direction in which said printing medium is fed.

11. A printer according to claim 7, wherein said carriage mounts the plurality of ink-jet heads so that all of the plurality of ink-jet heads follow a same moving path when said moving means moves said carriage in the moving direction.

12. A recording method for performing recording on a recording medium with a plurality of heads moving in a direction crossing a direction in which the recording medium is fed, said method comprising the steps of:

selecting between a first mode in which recording is performed in different recording colors by the plurality of heads, and a second mode in which recording is performed in a same recording color by the plurality of heads;

performing recording in one or more colors by driving the plurality of heads when the first mode is selected in said selecting step; and performing recording in the same recording color by alternately driving the plurality of heads for a predetermined number of lines when the second mode is selected in said selecting step.

13. A recording method according to claim 12, wherein said predetermined number is one.

14. A recording method according to claim 12, wherein said predetermined number is two or more.

15. A recording method according to claim 12, wherein said heads comprise ink-jet heads for recording on a recording medium by ejecting ink through ink ejection outlets.

16. A recording method according to claim 15, wherein said ink-jet heads are provided with electrothermal conversion members for generating heat energy for heating ink to eject the ink.

17. A recording method according to claim 16, wherein said ink-jet heads eject the ink through said ink ejection outlets by film boiling in the ink caused by heat energy generated by said electrothermal conversion members.

18. A recording method according to claim 12, wherein the recording heads to be driven in said performing steps are selected after determining in which direction the plurality of heads are moving.

19. A recording method according to claim 12, further comprising the step of effecting, prior to said recording performing steps of driving the recording heads, preliminary ejection by controlling driving of the recording heads to cause ink to be preliminarily ejected toward ink absorbing sections while controlling movement of the recording heads in the direction crossing the direction in which the recording medium is fed.

20. A recording apparatus which records on a recording medium with a plurality of recording heads, comprising:

a carriage for carrying the plurality of recording heads, said carriage being movable in a moving direction crossing a direction in which the recording medium is fed;

moving means for moving said carriage in the moving direction;

driving means for driving the recording heads on said carriage moved by said moving means;

means for selecting between a first mode in which recording is performed in different recording colors by the plurality of recording heads, and a second mode in which recording is performed in a same recording color by the plurality of recording heads; and control means for controlling recording by controlling said moving means to move said carriage and controlling said driving means to drive the recording heads to record in one or more colors when the first mode is selected by said selecting means, and for controlling recording by controlling said moving means to move said carriage and controlling said driving means to alternately drive the plurality of recording heads for a predetermined number of lines to record in the same recording color when the second mode is selected by said selecting means.

21. A recording apparatus according to claim 20, wherein, prior to recording by driving said recording heads, said control means effects preliminary ejection by controlling said driving means to cause ink to be preliminarily ejected toward ink absorbing sections while controlling said moving means to move said carriage carrying said recording heads in the moving direction crossing the direction in which said recording medium is fed.

22. A recording apparatus according to claim 20, wherein said predetermined number is one.

23. A recording apparatus according to claim 20, wherein said predetermined number is two or more.

24. A recording apparatus according to claim 20, wherein said heads comprise ink-jet heads for recording on a recording medium by ejecting ink through ink ejection outlets.

25. A recording apparatus according to claim 24, wherein said ink-jet heads are provided with electrothermal conversion members for generating heat energy for heating ink to eject the ink.

26. A recording apparatus according to claim 25, wherein said ink-jet heads eject the ink through said ink ejection outlets by film boiling in the ink caused by heat energy generated by said electrothermal conversion members.

27. A recording apparatus according to claim 20, wherein said control means selects the recording heads to be driven by said driving means after determining in which direction said carriage is moving.

28. A recording apparatus which records on a recording medium with a plurality of recording heads, comprising:

moving means for moving the plurality of recording heads movable in a moving direction crossing a direction in which the recording medium is fed;

driving means for driving the recording heads moved by said moving means; and control means for, when at least two of the plurality of recording heads are of a same recording color, controlling recording by controlling said moving means to move the plurality of recording heads and controlling said driving means to alternately drive the recording heads for a predetermined number of lines, wherein one line is recorded in each movement of the recording heads in the moving direction and the predetermined number is greater than one and wherein said control means controls said driving means to alternately drive the recording heads for the predetermined number of lines regardless of image data to be recorded.

29. A recording apparatus according to claim 28, wherein said recording heads comprise ink-jet recording heads which record on the recording medium by ejecting ink through ink ejection outlets.

30. A recording apparatus according to claim 29, wherein said ink-jet recording heads are provided with electrothermal conversion members for generating heat energy for heating ink to eject the ink.

31. A recording apparatus according to claim 30, wherein said ink-jet recording heads eject the ink through said ejection outlets by film boiling caused in the ink by heat energy generated by said electrothermal conversion members.

32. A recording apparatus according to claim 28, wherein, prior to recording by driving said recording heads, said control means effects preliminary ejection by controlling said driving means to cause ink to be preliminarily ejected toward ink absorbing sections while controlling said moving means to move said carriage carrying said recording heads in the moving direction crossing the direction in which said recording medium is fed.

33. A recording apparatus according to claim 28, wherein said moving means moves the plurality of recording heads so that all of the plurality of recording heads follow a same moving path.

* * * * *

UNITED STATES PATENT AND TRADEMARK OFFICE

CERTIFICATE OF CORRECTION

PATENT NO. : 5,880,749
DATED : March 9, 1999
INVENTOR(S) : Kikkawa et al.

It is certified that error appears in the above-identified patent and that said Letters Patent is hereby corrected as shown below:

Column 2,
Line 18, “it to” should read -- is to --.

Column 6,
Line 33, “indicated indicated” should read -- indicated --.

Column 7,
Line 8, “the the” should read -- the --.

Column 11,
Line 22, “section 40a” should read -- section 43a --.
Line 23, “section 40b” should read -- section 43b --.

Signed and Sealed this

Nineteenth Day of August, 2003

JAMES E. ROGAN
*Director of the United States Patent and Trademark Office*